US012523058B2

(12) United States Patent
Brezan

(10) Patent No.: US 12,523,058 B2
(45) Date of Patent: Jan. 13, 2026

(54) FOLDABLE TENT FRAME

(71) Applicant: ZEPELIN, S.R.O., Trenčín (SK)

(72) Inventor: Juraj Brezan, Trenčín (SK)

(73) Assignee: ZEPELIN, S.R.O., Trencín (SK)

( * ) Notice: Subject to any disclaimer, the term of this patent is extended or adjusted under 35 U.S.C. 154(b) by 135 days.

(21) Appl. No.: 18/245,640

(22) PCT Filed: Sep. 16, 2021

(86) PCT No.: PCT/SK2021/050011
§ 371 (c)(1),
(2) Date: Mar. 16, 2023

(87) PCT Pub. No.: WO2022/060302
PCT Pub. Date: Mar. 24, 2022

(65) Prior Publication Data

US 2023/0332428 A1 Oct. 19, 2023

(30) Foreign Application Priority Data

Sep. 16, 2020 (SK) ..... 50096-2020 U

(51) Int. Cl.
*E04H 15/48* (2006.01)

(52) U.S. Cl.
CPC ..... *E04H 15/48* (2013.01)

(58) Field of Classification Search
CPC ..... E04H 15/48
See application file for complete search history.

(56) References Cited

U.S. PATENT DOCUMENTS 4,066,089 A * 1/1978 Rainwater ..... E04H 15/48 135/117
5,167,246 A * 12/1992 Mortenson ..... E04H 15/48 403/92
5,454,624 A * 10/1995 Anglade ..... B60N 2/0292 297/378.12

(Continued)

FOREIGN PATENT DOCUMENTS

CN 101463671 A 6/2009
CN 106193790 A 12/2016

(Continued)

OTHER PUBLICATIONS

PCT International Search Report an Written Opinion for corresponding PCT Application No. PCT/SK2021/050011, mailed Mar. 1, 2022, 11 pages.

*Primary Examiner* — David R Dunn
*Assistant Examiner* — Danielle Jackson
(74) *Attorney, Agent, or Firm* — Dority & Manning, P.A.

(57) ABSTRACT

A foldable tent frame (1), which comprises portal frames (3) including rafters (4) connected to the ridge part (2, 24) of the portal frame (3) by pin joints (9) and posts (5) connected to the rafters (4) by pin joints (10), where the portal frames (3) are connected in a row by purlins (6), where the purlins (6) including ridge purlins (7) and eave purlins (8) are connected to the portal frames (3) by pin joints (11), and the purlins (6) comprise a pin joint (12) also on their length, where at least the ridge purlin (6, 7) is mounted rotationally around the axis perpendicular to the axis of the pin joint (11) of the purlin (6, 7) and the portal frame (3).

10 Claims, 6 Drawing Sheets

(56) References Cited

U.S. PATENT DOCUMENTS

| | | | | |
|---|---|---|---|---|
| 5,771,651 | A * | 6/1998 | Shiina | E04H 15/48 52/646 |
| 7,290,553 | B2 * | 11/2007 | Prevost | E04H 15/48 135/143 |
| 9,410,343 | B2 * | 8/2016 | Hotes | E04H 15/48 |
| 9,834,954 | B2 * | 12/2017 | Becher | E04H 15/405 |
| 10,392,828 | B2 * | 8/2019 | Johnson | E04H 15/48 |
| 10,794,080 | B2 * | 10/2020 | Johnson | E04H 15/18 |
| 2005/0005960 | A1 * | 1/2005 | Prevost | E04H 15/48 135/143 |
| 2011/0284044 | A1 * | 11/2011 | Baldussi | E04H 15/48 135/124 |
| 2013/0192653 | A1 * | 8/2013 | Watson | E04H 15/48 135/139 |
| 2016/0265246 | A1 * | 9/2016 | Becher | E04H 15/48 |

FOREIGN PATENT DOCUMENTS

| | | | | |
|---|---|---|---|---|
| FR | 3155250 | A1 * | 5/2025 | E04H 15/46 |
| GB | 982411 | A | 2/1965 | |
| GB | 2467385 | A | 8/2010 | |
| GB | 2475512 | A | 5/2011 | |

* cited by examiner

FOLDABLE TENT FRAME

TECHNICAL FIELD

The invention relates to a foldable tent frame.

BACKGROUND ART

Foldable tent frames having a gable roof are usually composed of portal frames, which comprise rafters and posts, where the rafters together, and the rafters and the posts together are mutually connected by a pin joint. Then, the portal frames are connected in a row by purlins usually at locations, or near locations, of pin joints of the frames. Here, two types of purlins can be recognized. The ridge purlins are placed in the location where the rafters join together, generally at the top of a tent frame. The eave purlins are placed in the location where the rafters join the posts, or in the case of a gambrel roof also between the rafters where the roof changes its slope.

The portal frames are usually folded in pin joints such that at the ridge, i.e. at the top of the frame, the rafters are folded towards each other. There are known solutions, where the rafters are connected together at their top by one pin joint, or other solutions are also known, where each rafter is connected to a ridge portion in one pin joint, that is each rafter separately in one own pin joint.

When unfolded, the pin joints are provided by a mechanical stop securing the correct angle of unfolded rafters. Regarding to prevailing vertical forces after unfolding the frame, mechanical securing of the position is usually not necessary as rafters rest against stops formed in the pin joint. The posts, when unfolded, rest vertically, or under steep angle, against the ground. Unlike rafters, the posts must be secured after their unfolding, in order to prevent them to fold accidentally and subsequent collapse of the tent frame due to a wind or other horizontally acting forces. Such securing is generally provided in the form of a securing pin inserted through the pin joint of the post and the rafter, and similar. During folding, the posts, considering a space between the folded rafters, are folded outwards to the outer side of the rafters, inwards to the inner side of the rafters, or are dismounted from the pin joint, usually by sliding it off.

In the solutions of foldable frames already known, ridge purlins are connected to the portal frame by a pin joint and usually they are divided. The eave purlins are usually in the middle provided by a pin joint and, after the frame is folded, their folded parts are side by side and as well as between rafters of adjacent frames.

The ridge purlins are typically disconnected into two parts when the frame is folded as these interfere with eave purlins. When the frame is folded, disconnected ridge purlins are folded to the rafter and folded eave purlins, or in the case of rafters being connected to the ridge part, one rafter in one own pin joint, disconnected ridge purlins are placed between folded rafters. Regarding that the length of one half of the ridge purlin is normally greater than height of the roof part of the frame, and such disconnected ridge purlin would form an obstruction during unfolding the frame, this ridge purlin can be shortened in telescopic manner. When the frame is unfolded, parts of the ridge purlin are mechanically connected together and can optionally be secured by a sleeve.

Solutions are known, where ridge purlins are provided by a pin joint in the middle, similarly as eave purlins. Such solution is preferable only in the case when the sum of lengths of folded ridge and eave purlin is smaller than the length of a rafter. It is preferable in this case, to orientate the folding direction of the ridge purlin in the same folding direction of one of the eave purlins, parallel to the rafter. The other possibility is to fold the ridge purlin perpendicularly downwards in regard to a foldable frame in its unfolded arrangement. However, when unfolding such frame, the ridge purlin collides with the ground.

Any other orientation of a folded ridge purlin, as was described above, is disadvantageous due to the fact that the ends of a folded ridge purlin would protrude from the envelope of the folded frame and thus they would require additional space to the space occupied by the folded frame itself.

Object of this invention is to substantially eliminate disadvantages of the state of the art.

SUMMARY OF INVENTION

Said object is achieved by a foldable tent frame, which comprises portal frames including rafters connected to the ridge part of the portal frame by pin joints and posts connected to the rafters by pin joints, where the portal frames are connected in a row by purlins, where the purlins including ridge purlins and eave purlins are connected to the portal frames by pin joints and the purlins comprise a pin joint also on their length, characterized in that at least the ridge purlin is mounted rotationally around the axis perpendicular to the axis of the pin joint of the purlin and the portal frame.

Preferably, the rotational mount of the purlin is provided with a limiting member of the purlin position. This limiting member, when the frame is folded, secures the purlin in required position and prevents accidental undesired turning of the purlin in the folded frame.

Preferably, the limiting member is in the form of a projection with a cylindrical surface, which is provided on a part of the pin joint connected to the ridge part of the portal frame, where the axis of the cylindrical surface is the same as the axis of the rotational mount of the purlin, and the cylindrical surface comprises at least one planar surface, where the ridge part comprises shaped slot with a circular part for the cylindrical surface of the projection and a linear part for inserting the planar surface of the projection after turning the purlin in the rotational mount, where the linear part is situated under the circular part in regard to the foldable frame being unfolded.

The limiting member can also be in the form of an end stop in the rotational mount of the part of the pin joint connected to the ridge part of the portal frame. This end stop protrudes to the rotational mount with two surfaces, against which sides of the body of the part of the pin joint connected to the ridge part of the portal frame stop when the purlin is rotated. These surfaces thus form the end stop for the sides of the body of the part of the pin joint connected to the ridge part of the portal frame. In the frame being unfolded, the purlin can be secured against its turning by a securing pin of the rotational mount of the purlin passing to the body of the ridge part of the portal frame.

Preferably the pin joint of the rafter and the post is provided with a securing pin, which passes through the pin joint in direction of the axis of rotation of the pin joint, and which is guided in the pin joint in an arcuate slot around the axis of rotation of the pin joint, where in one end position of the pin joint, which corresponds to the position of unfolded post and rafter, the securing pin is slidable in a slot, which is at the end of the arcuate slot led out of the curve direction of the arcuate slot.

Preferably, in order to prevent the securing pin from slipping out of the pin joint, the outer parts of the pin joint comprise only a slot, which is at the end of the arcuate slot led out of the curve direction of the arcuate slot, where this slot has smaller width than the arcuate slot and the slot led out of it in the inner part of the pin joint. Then, the securing pin is made at its ends with smaller diameter for the slot with smaller width.

BRIEF DESCRIPTION OF DRAWINGS

The invention is further explained in accompanying drawings, where.

EXAMPLES OF EMBODIMENTS

The invention will be described further in detail in examples of embodiments with reference to figures in the accompanying drawings. Arrows depicted in the figures show possible directions of rotation, displacement, or folding of individual parts of a foldable frame 1.

Figure 1:
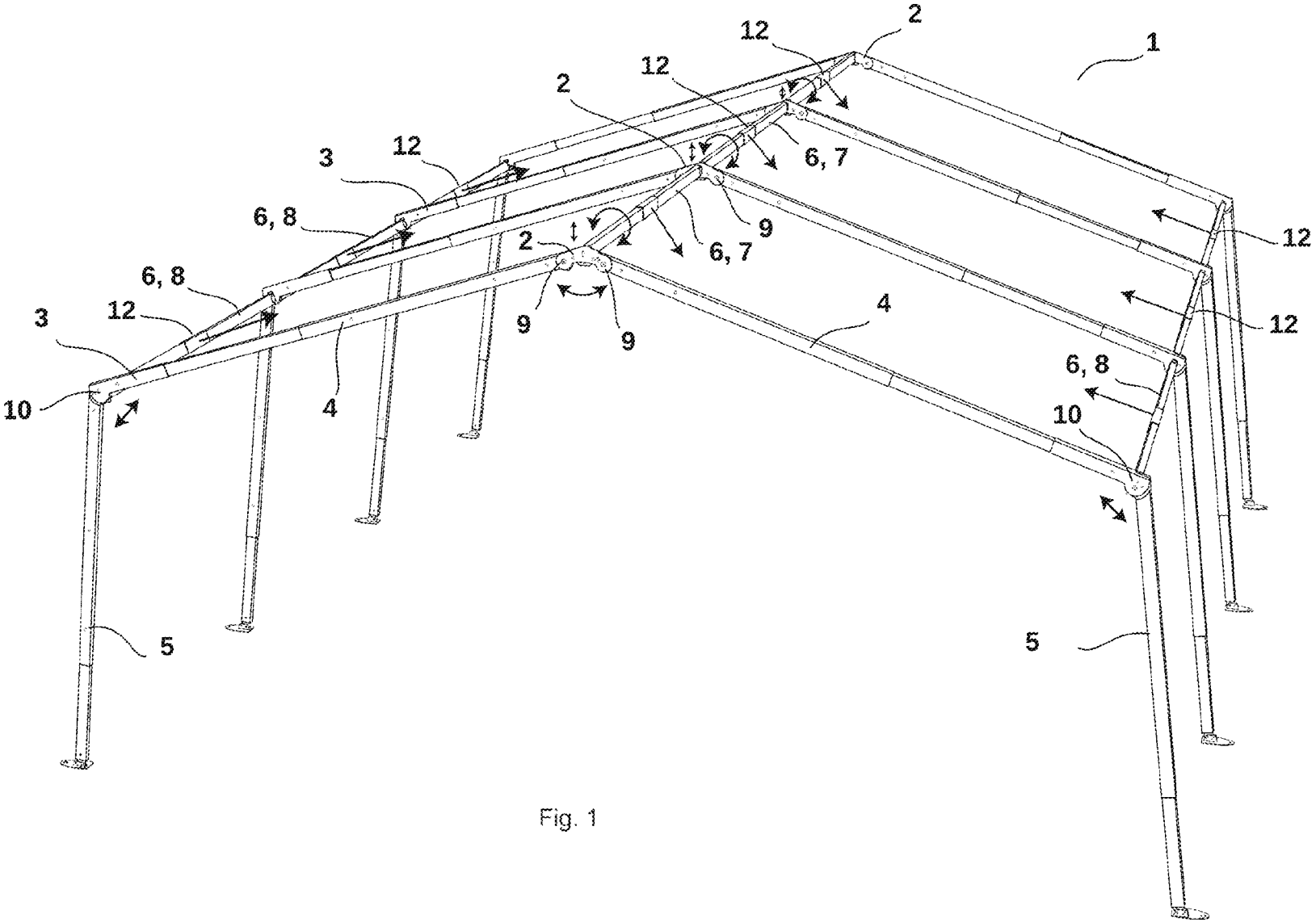
FIG. 1—schematically shows a foldable frame according to the invention.

In the example of embodiment of the foldable frame according to FIG. 1, the foldable frame 1 comprises portal frames 3, which are connected in a row by purlins 6. The portal frames 3 include rafters 4 connected to the ridge part 2 of the portal frame 3 by pin joints 9, and posts 5 connected to the rafters 4 by pin joints 10. The portal frames 3 are connected in a row by the purlins 6. Purlins 6 include ridge purlins 7 and eave purlins 8. The purlins 6 are connected to the portal frames 3 by pin joints 11. The purlins also comprise a pin joint 12 on their length, which allows folding of this purlin when folding the frame 1. The pin joints 12 are preferably provided with known securing member in the form of a pin, a catch, a sliding sleeve and similar. The ridge purlin 6, 7 is mounted rotationally around the axis perpendicular to the axis of the pin joint 11 of the purlin 6 and the portal frame 3. The pin joints 9, 10, 11, 12 are single axis pin joints. Axes of the pin joints 11 of the eave purlins 8 and the rafters 4 are perpendicular to longitudinal direction of the rafters 4, thus these eave purlins 8 are in fact parallel with the rafters 4 when the frame 1 is folded.

Figure 2:
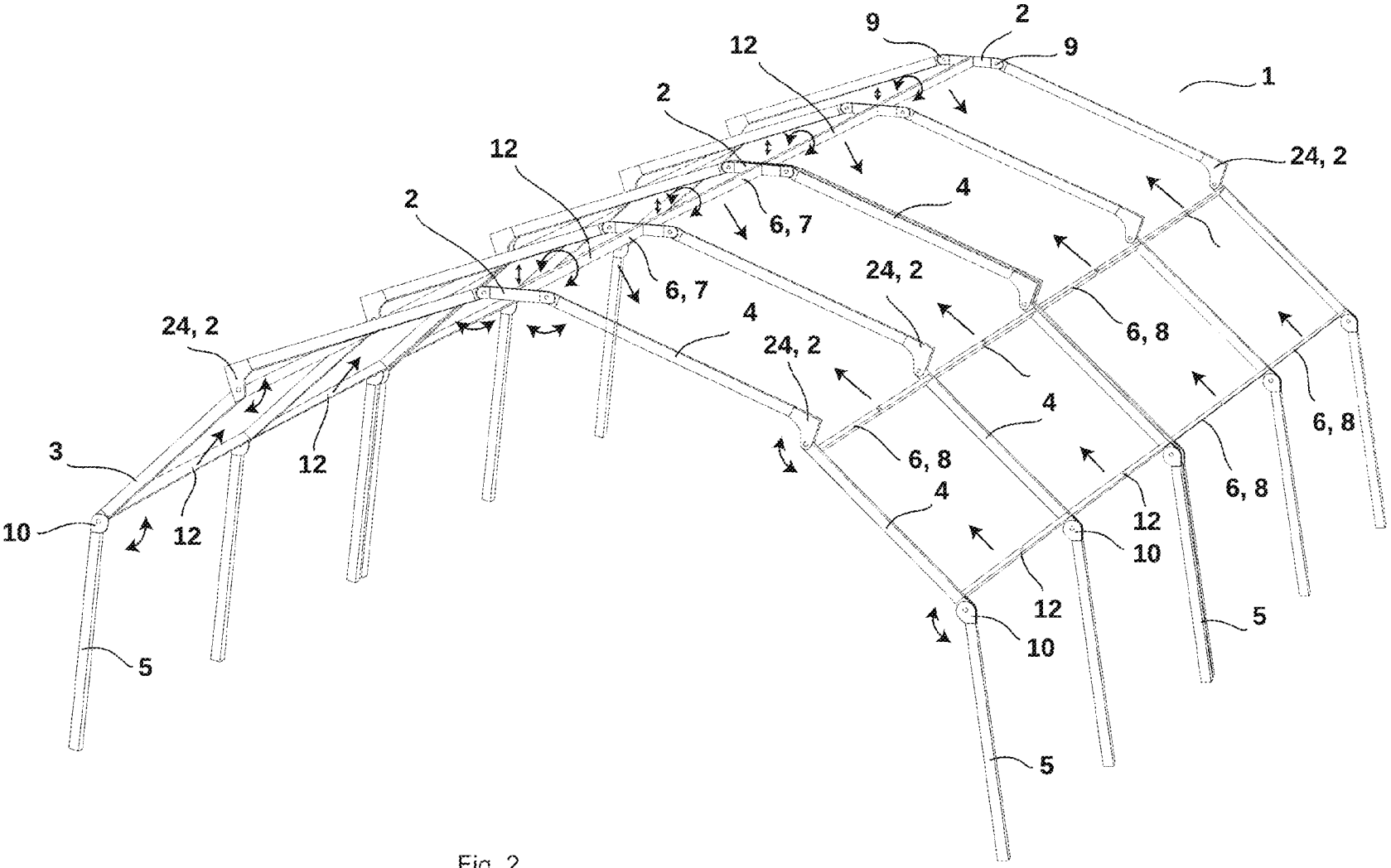
FIG. 2—schematically shows a foldable frame according to the invention for a gambrel roof.

The rotational mount of the purlin 6, in this example of the ridge purlin 7, is in the example of embodiment according to FIG. 2 provided by mounting one part of the pin joint 11 connected to the ridge part 2 of the portal frame 3 rotationally. This rotational mount can be realized by a bolt, a pivot, or any other known axial connection allowing rotational connection.

When folding or unfolding the frame, the rotational mount of the purlin 6, 7 allows turning of the purlin as necessary to avoid collision with the ground or other parts of the frame 1, and also makes possible that the purlin 6, 7 does not anyhow protrude from the frame 1, when this frame 1 is folded.

Range of rotation of the purlin 6, 7 around the axis perpendicular to the axis of the pin joint 11 of the purlin 6, 7 and the portal frame 3, that is around own longitudinal axis of the purlin 6, 7 can be unlimited.

Preferably it is practical, especially in order to avoid accidental undesired rotation of the purlin 6, 7 in folded frame 1, to provide the rotational mount of the purlin 6, 7 with a limiting member 13 of a position of the purlin 6, 7.

Figure 3:
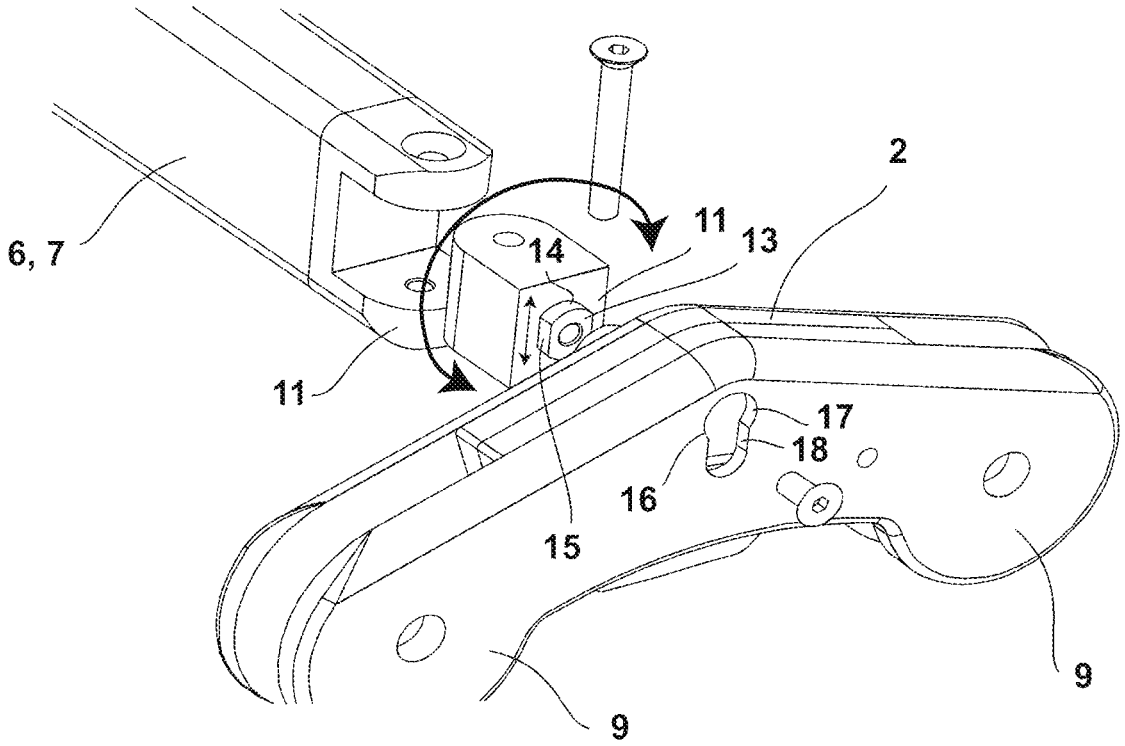
FIG. 3—schematically shows an example of embodiment of rotative mount of the ridge purlin with a limiting member of the purlin position.

Preferably, for simple securing the purlin 6, 7 against turning when the frame 1 is unfolded, the rotational mount of the purlin 6, 7 is provided by the embodiment of the limiting member 13 as shown in the example in FIG. 3.

The limiting member 13 according to FIG. 3 is made in the form of a projection with a cylindrical surface 14. This projection is provided on the part of the pin joint 11 connected to the ridge part 2 of the portal frame 3. Axis of the cylindrical surface 14 is the same as the axis of the rotational mount of the purlin 7. The cylindrical surface 14 comprises at least one planar surface 15, in this example two parallel planar surfaces 15. The ridge part 2 then comprises shaped slot 16 with a circular part 17 for the cylindrical surface 14 of the projection and a linear part 18 for inserting the planar surface 15, in this example two planar surfaces 15 of the projection, upon turning the purlin 7 in the rotational mount. The linear part 18 is situated under the circular part 17 in regard to the foldable frame 1 in unfolded state. When unfolding the frame 1 with the limiting member 13 according to FIG. 3, the purlin can freely turn around its longitudinal axis due to the circular part 17 of the shaped slot 16. In order to secure the position of the purlin 6, 7, it is sufficient to align the planar surface 15, in this example two parallel planar surfaces 15, with linear parts 18 of the shaped slot 18. Thus, the projection provided on the part of the pin joint 11 connected to the ridge part of the portal frame 3 slides into the linear parts 18 of the shaped slot 16, while securing the purlin 6, 7 against its rotation. As the linear part 18 of the shaped slot 16 is situated under the circular part 17 of the shaped slot, the purlin 6, 7 is held in secured position in fact due to gravity.

When folding the frame 1 with the limiting member 13 according to FIG. 3, in fact steps in the opposite order are taken, that is the limiting member 13 is displaced from the linear parts 18 of the shaped slot 16 to the circular part 17 of the shaped slot, when it is possible to rotate the purlin 6, 7 as necessary during the frame 1 is being folded.

Figure 4:
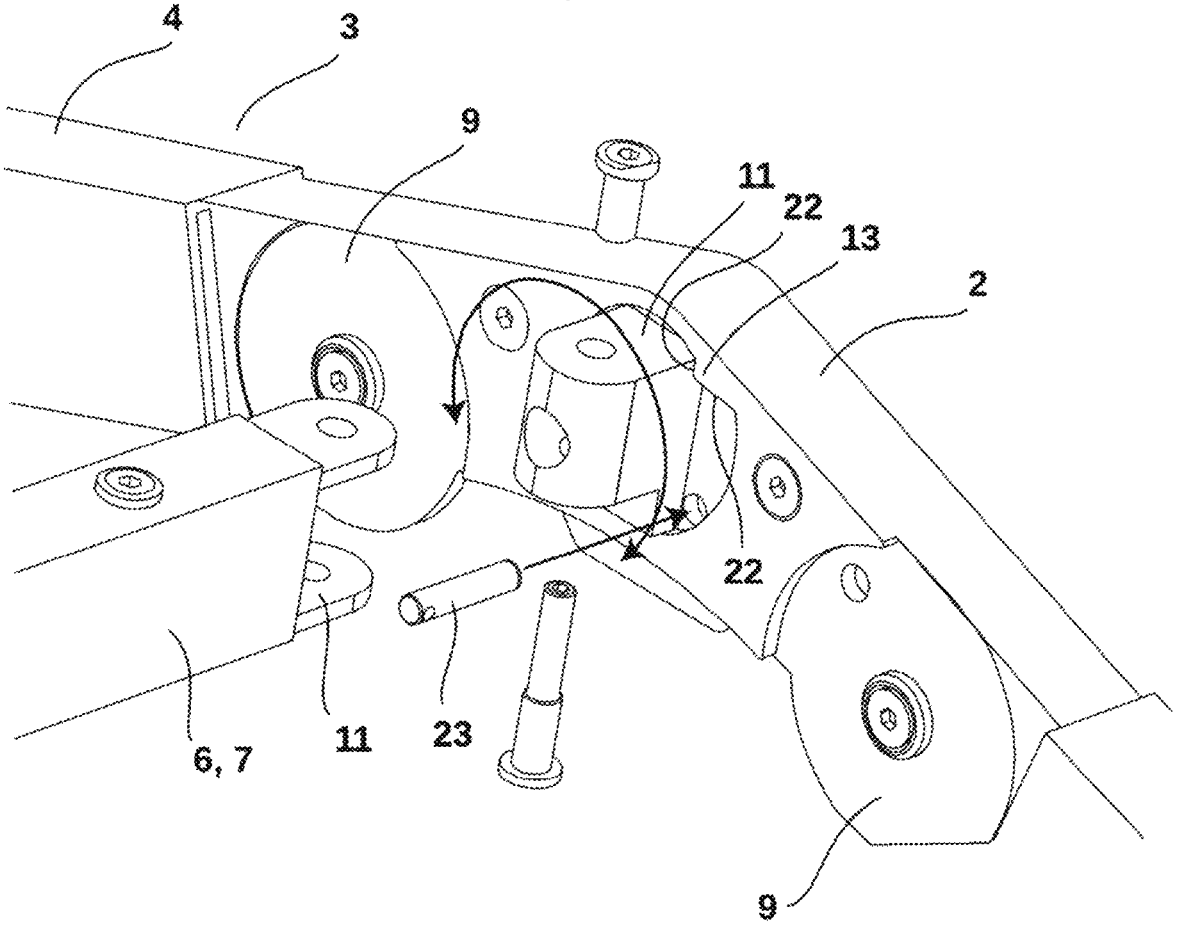
FIG. 4—schematically shows an example of embodiment of rotative mount of the ridge purlin with a variant of the limiting member of the purlin position.

Another example of embodiment of the limiting member 13 of the purlin 6, 7 is shown in FIG. 4. Here, the limiting member 13 is in the form of an end stop in the rotational mount of the part of the pin joint 11 connected to the ridge part 2 of the portal frame 3. This end stop protrudes to the rotational mount with two perpendicular surfaces 22, against which perpendicular sides of the body of the part of the pin joint 11 connected to the ridge part 2 stop when the purlin 6, 7 is rotated. Then, when the frame is unfolded, the purlin 6, 7 can be secured against its turning by a securing pin 23 of the rotational mount of the purlin 6, 7, passing to the body of the ridge part 2.

Figure 5:
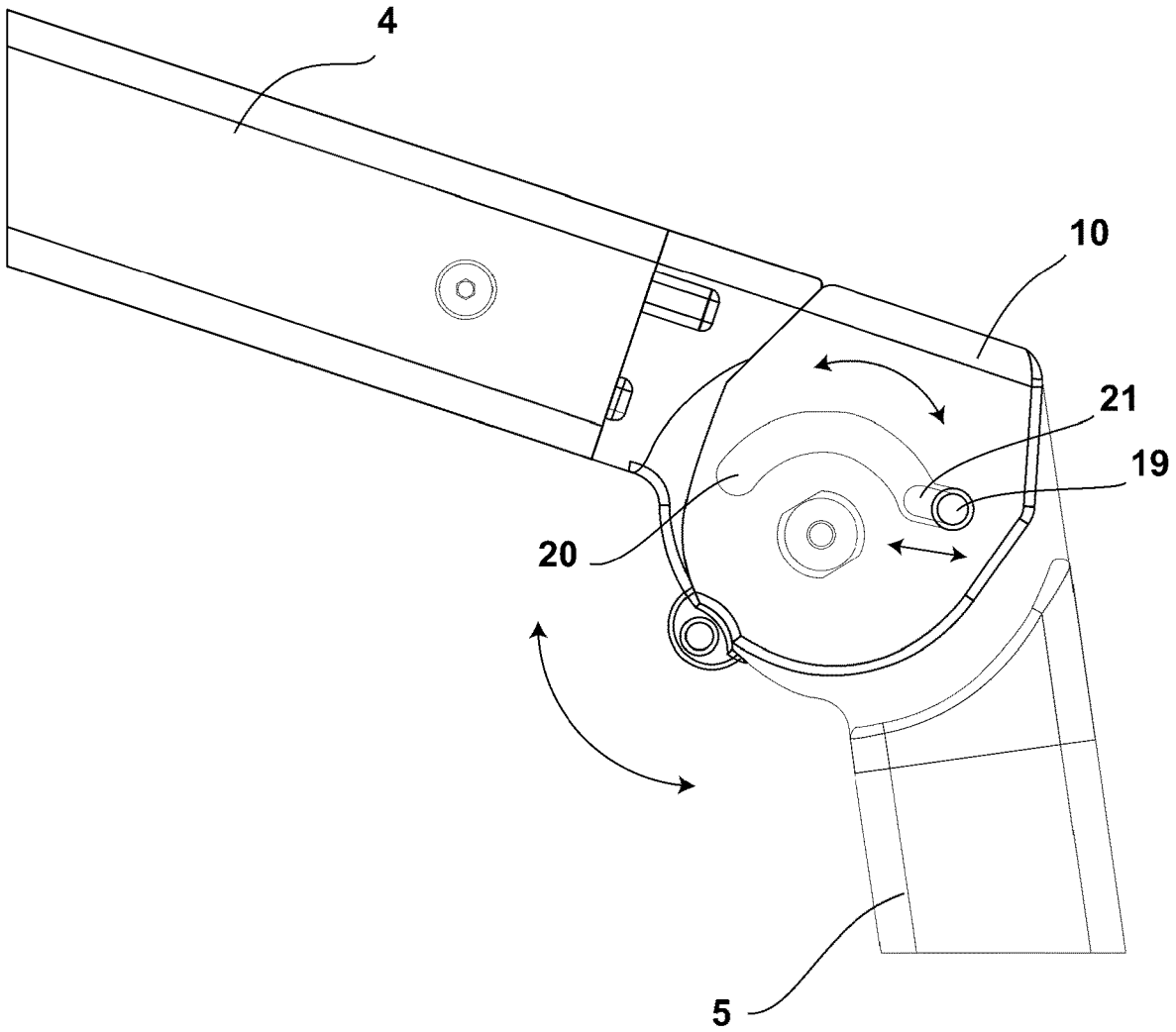
FIG. 5—schematically shows an example of embodiment of a pin joint of the rafter and the post with a securing pin.

The pin joint 10 of the rafter 4 and the post 5, according to the embodiment in FIG. 5, is preferably provided with a securing pin 19, which passes through the pin joint 10 in direction of the axis of rotation of the pin joint 10. The securing pin 19 is guided in the pin joint 10 in an arcuate slot 20 around the axis of rotation of the pin joint 10. In one end position of the pin joint 10, which corresponds to the position of unfolded post 5 and rafter 4, the securing pin 19 is slidable in a slot 21, which is at the end of the arcuate slot 20 led out of the curve direction of said arcuate slot 20.

In order to prevent the securing pin 19 from slipping out of the pin joint 10, the outer parts of the pin joint 10 preferably comprise only a slot 21, while this slot has smaller width than the arcuate slot 20 and the slot 21 led out of it in the inner part of the pin joint 10. Then, the securing pin 19 is made at its ends with smaller diameter for the slot 21 with smaller width. In this manner, the outer parts of the pin joint 10 hold the securing pin 19 preventing it from slipping out.

When unfolding the posts 5, the securing pin 19 is guided by the outer parts of the pin joint 10 in the arcuate slot 20 in the inner part of the pin joint 10, and when the post 5 reaches fully unfolded position, the securing pin 19 is displaced, either by gravity or manually, to the slot 21 out of the curve of the arcuate slot 20, whereby securing the pin joint 10 against rotation.

When folding the posts 5, the securing pin 19 is displaced from the slot 21 into the arcuate slot 20, whereby releasing the pin joint 10. Then, the securing pin 19 is guided by the outer parts of the pin joint 10 in the arcuate slot 20 in the inner part of the pin joint 10.

In the example of embodiment of the foldable tent frame 1 according to FIG. 2, the foldable frame has the same arrangement as was described above in the example of embodiment according to the FIG. 1, except that the rafters 4 comprise further pin joint 24 on their length to angle the rafter 4 for creating a gambrel roof. If, in such embodiment, the purlin 6 is placed at the location where the roof changes its slope, that is another eave purlin 8, a spacing of individual portal frames 3 is important. If the length of the purlins 6, 8 is twice or more the length of adjacent rafter 4, a spatial conflict occurs when folding the frame 1 as alike as with the ridge purlin 7. In such case, it is preferable to create analogous rotational mount of the purlin 6, 8 at this position, as is the rotational mount of the ridge purlin 7 described above.

Similarly, the limiting member 13 can also be provided, while the ridge part 2 of the portal frame 3 is understood also including the pin joint 24, or location around the pin joint 24, while the pin joint can be made in the above-described embodiment of the ridge part 2 with two pin joints, each for one rafter.

Figure 6:
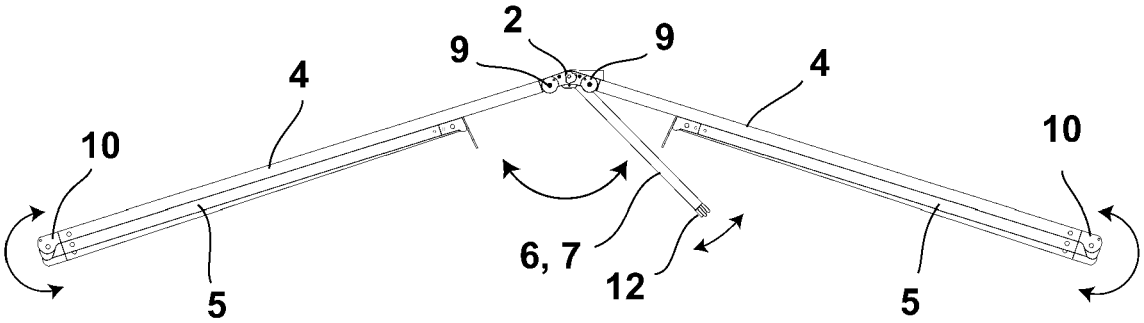
FIG. 6—schematically shows the foldable frame of FIG. 1 as partially and later completely folded.
Figure 6:
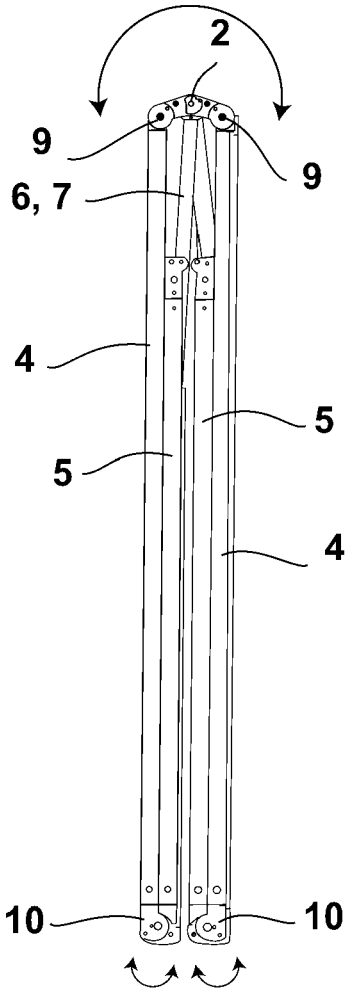
Figure 7:
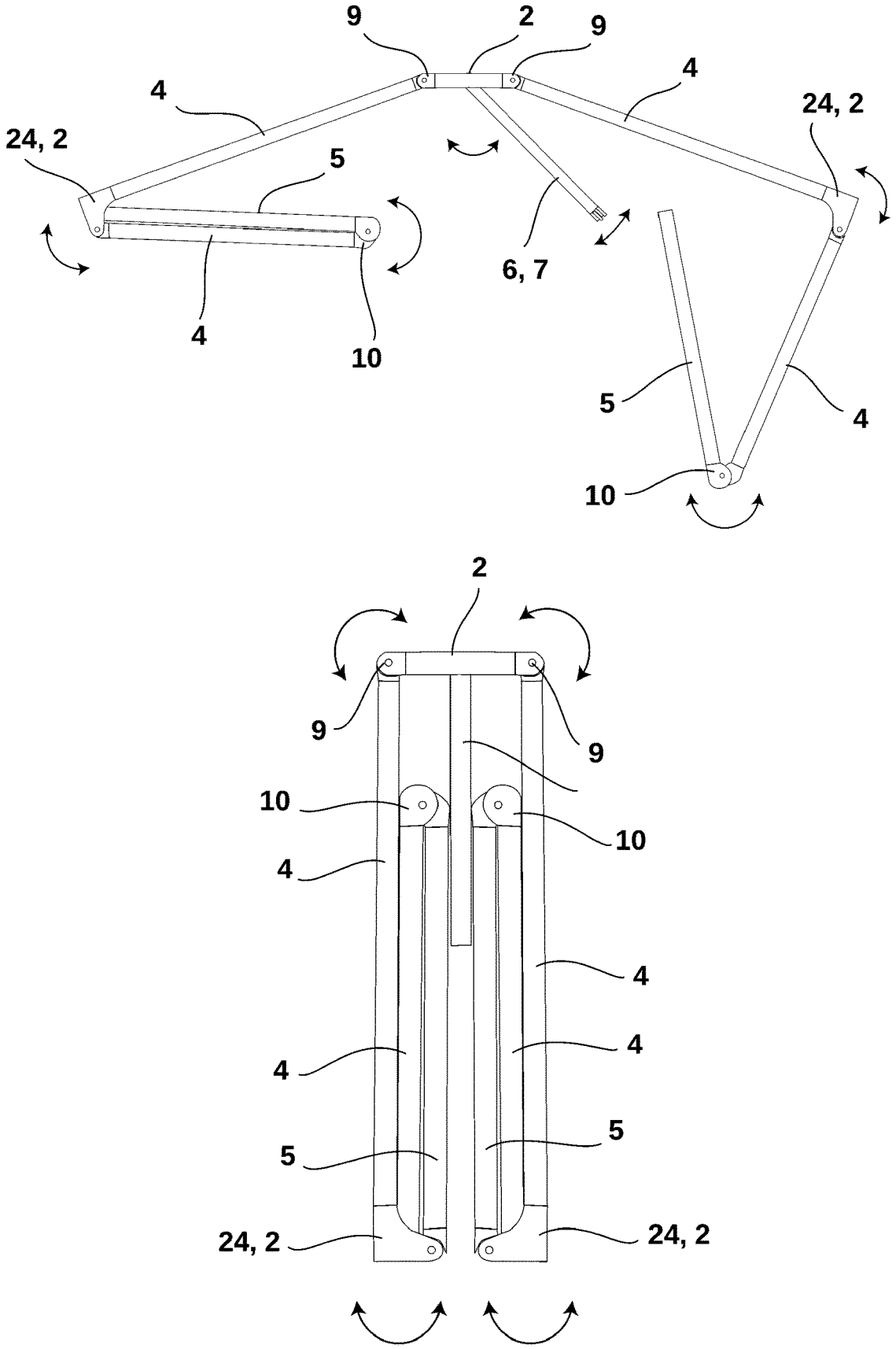
FIG. 7—schematically show the foldable frame of FIG. 2 as partially and later completely folded.

For illustrative purposes, FIG. 6 shows the folding frame 1 according to the example of embodiment described above with reference to FIG. 1, and FIG. 7 shows the foldable frame 1 according to the example of embodiment described above with reference to FIG. 2 as partially folded and later completely folded.

Regarding rigidity of the structure, it is preferable to fold the posts 5 inwards the portal frame 3. In such arrangement, weight of the structure rests on bearing surfaces formed on the pin joint 10 of the rafter 4 and the post, and which prevents shear forces acting on the securing member that secures correct angle between the post 5 and the rafter 4. When the posts 5 are folded inwards the portal frame 3, it is preferable to use the ridge part 2 with two pin joints 9, that is separate pin joint 9 for each rafter 4. Necessary space is thereby provided between folded rafters 4 for the posts folded inwards.

In order to have the folded frame 1 completely compact, it is preferable to provide the posts and also the rafters 4 in similar cross-section shapes with two different dimensions, which are inserted one to the other and secured against accidental sliding by means of integrated securing members, preferably in the form of spring-loaded lock pins. When the frame 1 is unfolded, the posts 5 and the rafters 4 are extended to their full working length, while when the frame 1 is folded, the posts 5 and the rafters 4 are shortened to a transportation length in order to achieve the most compact folded frame 1.

The above-mentioned examples of embodiments described with reference to the figures in accompanying drawings are illustrative and not limiting the nature of this invention to these specific examples only.

The foldable tent frame 1 according to the invention represents compact arrangement of the structure components allowing economical transport in folded state, simple and fast unfolding without a need of external connection components and a need for disconnecting the frame 1 to several parts. When unfolded, the frame 1 is secured against accidental folding and designed for transferring of forces in directions, in which the frame is the most subjected to stress when used.

Compactness of the frame 1 is presented also in fact that it does not have to include any separate securing means or parts, facilitates reliability in use, because a possibility of losing any fastening or securing material or supporting parts of the frame 1, which is important especially when used for armed or police forces and rescue teams in the form of command, accommodation, medical, triage, decontamination and other tents with the requirement of fast deployment and reliability in use.

The invention claimed is:

1. A foldable tent frame, which comprises a plurality of portal frames, each portal frame of the plurality of portal frames including one or more rafters connected to a ridge part of the corresponding portal frame by one or more first pin joints and one or more posts connected to the one or more rafters by one or more second pin joints, where the plurality of portal frames are connected in a row by a plurality of purlins, wherein the plurality of purlins include one or more ridge purlins and one or more eave purlins, wherein the one or more ridge purlins are connected to the plurality of portal frames by one or more third pin joints, wherein the one or more eave purlins comprise a fourth pin joint along a length of the one or more eave purlins, wherein at least one ridge purlin of the one or more the ridge purlins is mounted rotationally around a first axis that is perpendicular to an axis of at least one third pin joint of the one or more third pin joints, wherein a rotational mount of the at least one ridge purlin is provided by a rotational connection between of a first part of the at least one third pin joint and the ridge part, wherein at least one second pin joint of the plurality of second pin joints connects a corresponding rafter and a corresponding post, wherein the at least one second pin joint is provided with a securing pin, which passes through the at least one second pin joint in a direction of an axis of rotation of the at least one second pin joint, wherein the securing pin is guided in the at least one second pin joint in an arcuate slot around the axis of rotation of the at least one second pin joint, wherein the corresponding rafter and the corresponding post are movable to an unfolded state position, wherein one end position of the at least one second pin joint corresponds to the unfolded state position of the corresponding rafter and the corresponding post, wherein the arcuate slot defines a curve direction, wherein a slot extends from the arcuate slot in a predetermined direction, and wherein the predetermined direction is different from the curve direction, wherein the slot has a smaller width than a portion of the arcuate slot defined along the curve direction, and wherein the securing pin comprises one or more ends defining a smaller diameter received within the smaller width of the slot.

2. The foldable tent frame according to claim 1, wherein the rotational mount of the at least one ridge purlin is provided with a limiting member, the limiting member limiting a position of the at least one ridge purlin.

3. The foldable tent frame according to claim 2, wherein the limiting member is in the form of a projection with a cylindrical surface, which is provided on a part of the at least one third pin joint, wherein an axis of the cylindrical surface is the same as an axis of the rotational mount of the at least one ridge purlin, and the cylindrical surface comprises at least one planar surface, where the ridge part comprises a shaped slot with a circular part for the cylindrical surface of the projection and a linear part for inserting the planar surface of the projection after turning the at least one ridge purlin in the rotational mount, where the linear part is situated under the circular part in an unfolded state of the foldable frame.

4. The foldable tent frame according to claim 2, wherein the limiting member is in the form of an end stop in the rotational connection of the first part of the at least one third pin joint and the ridge part of the portal frame, where said end stop protrudes to the rotational mount with two surfaces, which form the end stop for two or more sides of the first part of the at least one third pin joint, where the rotational mount is provided with a securing pin passing to the ridge part of the portal frame.

5. A foldable tent frame, which comprises a plurality of portal frames, each portal frame of the plurality of portal frames including one or more rafters connected to a ridge part of the corresponding portal frame by one or more first pin joints and one or more posts connected to the one or more rafters by one or more second pin joints, where the plurality of portal frames are connected in a row by a plurality of purlins, wherein the plurality of purlins include one or more ridge purlins and one or more eave purlins, wherein the one or more ridge purlins are connected to the plurality of portal frames by one or more third pin joints, wherein the one or more eave purlins comprise a fourth pin joint along a length of the one or more eave purlins, wherein at least one ridge purlin of the one or more the ridge purlins is mounted rotationally around a first axis that is perpendicular to an axis of at least one third pin joint of the one or more third pin joints, wherein a rotational mount of the at least one ridge purlin is provided with a limiting member, the limiting member limiting a position of the at least one ridge purlin, wherein the limiting member is in the form of a projection with a cylindrical surface, which is provided on a part of the at least one third pin joint, wherein an axis of the cylindrical surface is the same as an axis of the rotational mount of the at least one ridge purlin, and the cylindrical surface comprises at least one planar surface, wherein the ridge part comprises a shaped slot with a circular part for the cylindrical surface of the projection and a linear part for inserting the planar surface of the projection after turning the at least one ridge purlin in the rotational mount, and wherein the linear part is situated under the circular part in an unfolded state of the foldable frame.

6. The foldable tent frame according to claim 5, wherein at least one second pin joint of the plurality of first second pin joints connects a corresponding rafter and a corresponding post, wherein the at least one second pin joint is provided with a securing pin, which passes through the at least one second pin joint in a direction of an axis of rotation of the at least one second pin joint, wherein the securing pin is guided in the at least one second pin joint in an arcuate slot around the axis of rotation of the at least one second pin joint, wherein the corresponding rafter and the corresponding post are movable to an unfolded state position, wherein one end position of the at least one second pin joint corresponds to the unfolded state position of the corresponding rafter and the corresponding post, wherein the arcuate slot defines a curve direction, wherein a slot extends from the arcuate slot in a predetermined direction, and wherein the predetermined direction is different from the curve direction.

7. The foldable tent frame according to claim 6, wherein the slot has a smaller width than a portion of the arcuate slot defined along the curve direction, and wherein the securing pin comprises one or more ends defining a smaller diameter received within the smaller width of the slot.

8. A foldable tent frame, which comprises a plurality of portal frames, each portal frame of the plurality of portal frames including one or more rafters connected to a ridge part of the corresponding portal frame by one or more first pin joints and one or more posts connected to the one or more rafters by one or more second pin joints, where the plurality of portal frames are connected in a row by a plurality of purlins, wherein the plurality of purlins include one or more ridge purlins and one or more eave purlins, wherein the one or more ridge purlins are connected to the plurality of portal frames by one or more third pin joints, wherein the one or more eave purlins comprise a fourth pin joint along a length of the one or more eave purlins, wherein at least one ridge purlin of the one or more the ridge purlins is mounted rotationally around a first axis that is perpendicular to an axis of at least one third pin joint of the one or more third pin joints, wherein rotational mount of the at least one ridge purlin is provided with a limiting member, the limiting member limiting a position of the at least one ridge purlin, wherein the limiting member is in the form of an end stop in the rotational connection of the first part of the at least one third pin joint and the ridge part of the portal frame, wherein said end stop protrudes to the rotational mount with two surfaces, which form the end stop for two or more sides of the first part of the at least one third pin joint, and wherein the rotational mount is provided with a securing pin passing to the ridge part of the portal frame.

9. The foldable tent frame according to claim 8, wherein at least one second pin joint of the plurality of second pin joints connects a corresponding rafter and a corresponding post, wherein the at least one second pin joint is provided with a securing pin, which passes through the at least one first second pin joint in a direction of an axis of rotation of the at least one second pin joint, wherein the securing pin is guided in the at least one second pin joint in an arcuate slot around the axis of rotation of the at least one second pin joint, wherein the corresponding rafter and the corresponding post are movable to an unfolded state position, wherein one end position of the at least one second pin joint corresponds to the unfolded state position of the corresponding rafter and the corresponding post, wherein the arcuate slot defines a curve direction, wherein a slot extends from the arcuate slot in a predetermined direction, and wherein the predetermined direction is different from the curve direction.

10. The foldable tent frame according to claim 9, wherein the slot has a smaller width than a portion of the arcuate slot defined along the curve direction, and wherein the securing pin comprises one or more ends defining a smaller diameter received within the smaller width of the slot.

* * * * *